United States Patent [19]

Arter et al.

[11] Patent Number: 4,732,083

[45] Date of Patent: Mar. 22, 1988

[54] ROTARY DIE CYLINDER ASSEMBLY

[75] Inventors: James B. Arter, Breese, Ill.; Thomas M. Serra, High Ridge, Mo.

[73] Assignee: Allied Gear and Machine Co., St. Louis, Mo.

[21] Appl. No.: 928,924

[22] Filed: Nov. 7, 1986

[51] Int. Cl.[4] ..... B41F 13/10; B41F 13/56

[52] U.S. Cl. ..... 101/28; 101/375; 101/226; 83/665

[58] Field of Search ..... 101/224, 226, 227, 375, 101/376, 28, 5, 6, 22, 23, 24, 25, 7, 8, 16, 368, 29, 31; 83/498, 499, 504, 507, 508.2, 508.3, 471.3, 477, 481, 659, 665, 666, 699, 700, 698, 425.4, 428; 403/356, 358, 362, 379

[56] References Cited

U.S. PATENT DOCUMENTS 503,751 8/1893 Robinson ..... 83/498
1,762,992 6/1930 Kelly ..... 101/375 X
2,929,319 3/1960 Skow ..... 101/375
4,237,761 12/1980 Coburn ..... 83/504

*Primary Examiner*—J. Reed Fisher
*Attorney, Agent, or Firm*—Cohn, Powell & Hind

[57] ABSTRACT

This rotary die cylinder assembly (10) is adapted for mounting annular members such as rotary knives (18) in locked relation thereon. The cylinder (12) includes a lengthwise extending slot (28) and a plurality of transverse bores (34) spaced lengthwise of the slot (28) and communicating with said slot. An elongate pressure bar (44) is received within said slot and set screws (46) are provided within said bores which are engageable with the pressure bar (44) to move said bar outwardly of said slot and into engagement with said annular member. Each member mounted on the cylinder is provided with arcuate slot (54) mating with the cylinder slot (28) and receiving the pressure bar (44) in accurately fitted locked relation when the set screws (46) are tightened.

12 Claims, 5 Drawing Figures

ROTARY DIE CYLINDER ASSEMBLY

BACKGROUND OF THE INVENTION

This invention relates generally to rotary die cylinders used in the printing industry and particularly to a rotary die cylinder assembly having an improved means of attaching rotary cutting tools and the like used for slitting, scoring, perforating or line hole punching operations, to the cylinder.

The conventional method of attaching rotary knives, dies and bearers and the like onto cylinders is by the use of square or rectangular keys, disposed between the cylinder and the member to be attached, in combination with a set-screw provided in the attached member and engaging a flat or conical groove provided on the cylinder. The key is intended to prevent relative rotational movement and the set screw to prevent relative longitudinal movement of the attached member. The disadvantage of this system of attachment lies in the inherent mismatch potential of standard keys and keyways and to the tendency of individual set screws to permit cocking of the mounted member within the clearance range of the connected parts.

Although there have been improvements proposed to overcome these disadvantages, such proposals take a different approach to that proposed in the present invention. For example, U.S. Pat. No. 2,807,485 (Seibert) discloses a tubular slotted key that is expanded by the set screw of the mounted member. U.S. Pat. No. 780,850 (Williams) discloses a set screw used in combination with multiple pressure bars to hold the mounted member in place. U.S. Pat. No. 3,951,024 (Weiskopf) discloses the use of fluid pressure applied throught the shaft to hold pressure hoses against a rectangular key. The special devices inherently utilize complicated and therefore inevitably expensive parts.

The present invention avoids the above disadvantages in a manner not revealed by the known prior art.

SUMMARY OF THE INVENTION

This invention provides a rotary die cylinder assembly with the means for attaching removable dies and bearers accurately and securely. The assembly structural arrangement of parts facilitates repeatable guide positioning when the dies are removed and replaced by new or re-ground units.

The rotary die cylinder assembly includes a cylinder having an outer surface, an elongate slot extending lengthwise of said outer surface and a plurality of transverse threaded bores each including opposed ends, one of said ends communicating with the slot and the other of said ends communicating with the outer surface of the cylinder in circumferentially spaced relation to said slot; an elongate pressure bar received within the slot and extendable outwardly of the slot; a plurality of threaded elements each received within an associated bore and each including a remote end engageable with the pressure bar tending to move said bar outwardly of said slot, and a plurality of annular members, each having an inner surface receiving the outer surface of the cylinder in sliding relation said inner surface including a bearing portion receiving a portion of the bar in pressure relation when the bar moves outwardly.

It is an aspect of this invention to provide a pressure bar having a circular cross section and to provide an annular member bearing portion in the form of an arcuate slot receiving the pressure bar therewithin.

It is another aspect of this invention to provide that the transverse bores are diametrically opposed disposed relative to the cylinder.

Yet another aspect of this invention is to provide that the annular members are disposed in spaced relation lengthwise of the cylinder and to provide a transverse bore on at least each side of at least one of the annular members, said bore open end being substantially clear of said annular member.

Still another aspect of this invention is to provide that at least one of the annular members is a rotary die and another of the annular members is a bearer.

Another aspect of this invention is to provide that the annular member bearing portion arcuate slot receiving the pressure bar therein has a depth less than the radius of the bar.

Yet another aspect of this invention is to provide that the cylinder slot has a lower arcuate portion and an upper portion having parallel sides, said slot having a depth greater than the radius of the bar but less than the diameter of the bar.

It is another aspect of this invention to provide a plurality of set screws, each received in threadedly adjustable relation within a threaded portion of the bore, said set screws being shorter than the length of their associated bores and said bores including an enlarged diameter unthreaded portion having an open end substantially clear of the annular member to permit a set screw adjusting tool to be received therein.

It is an aspect of this invention to provide a rotary die cylinder assembly which is relatively simple and inexpensive to manufacture and relatively easy to use and that facilitates accurate placement and re-placement of annular members.

DESCRIPTION OF THE PREFERRED EMBODIMENT

Figure 1:
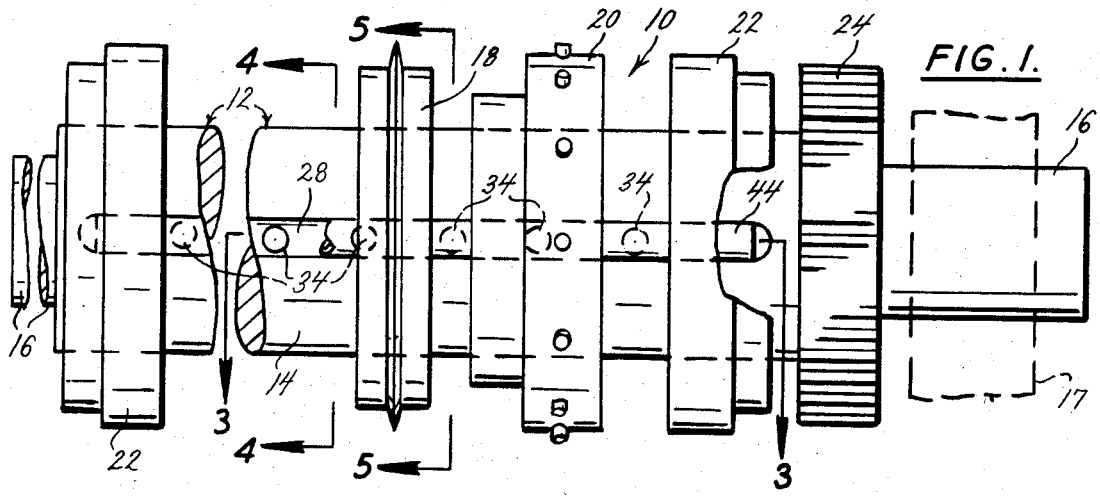
FIG. 1 is a fragmentary elevational view of a rotary die cylinder incorporating the arbor attachment and taken from one side of the cylinder.
Figure 3:
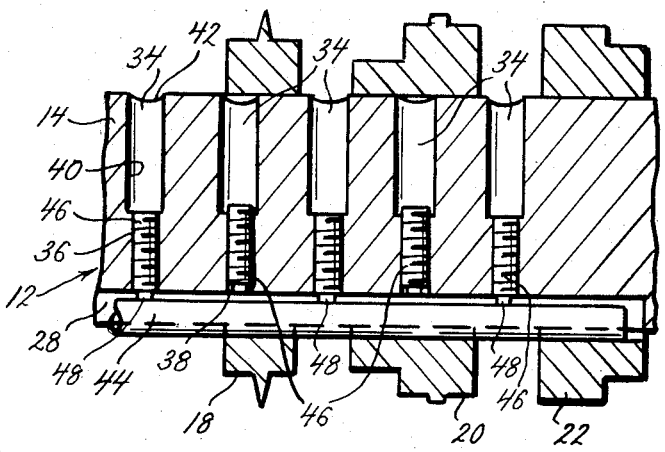
FIG. 3 is a longitudinal sectional elevational view taken on line 3—3 of FIG. 1.
Figure 2:
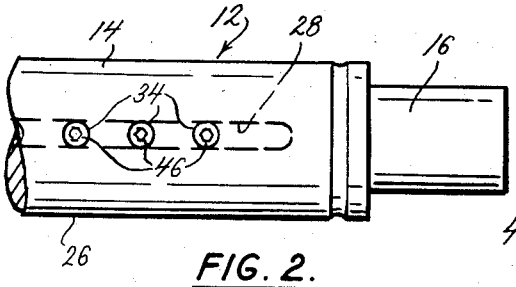
FIG. 2 is a fragmentary elevational view of the rotary die cylinder rotated through one hundred eighty degrees.

Referring now by reference numerals to the drawings and first to FIGS. 1–3 it will be understood that the rotary die cylinder assembly is indicated by numeral 10. The assembly includes cylinder 12 having an intermediate portion 14 and end portions 16 carried by side plates 17 shown in phantom outline. The intermediate portion 14 is adapted to carry a plurality of annular tool members in locked relation, and such members will typically include several rotary knives 18, rotary dies 20 and, in addition, a pair of bearers 22. The cylinder 12 also carries a gear 24 but, in the preferred embodiment, said gear is conventionally locked in place on the cylinder intermediate portion 14 as by set screws and key (not shown). The locking attachment of the members 18, 20 and 22 will now be described.

The cylinder intermediate portion 14 includes a cylindrical outer surface 26 having an elongate slot 28 extending lengthwise for substantially the entire length of said intermediate portion. As clearly shown in FIG. 4 the slot 28 includes a generally semi-circular inner portion 30 and an outer portion 32 having parallel sides.

Figure 5:
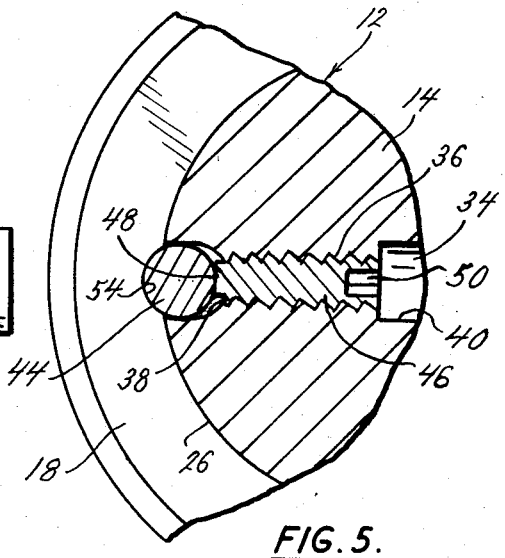
FIG. 5 is a fragmentary cross sectional view taken on line 5—5 of FIG. 1 showing the pressure bar in place.

The cylinder intermediate portion 14 also includes a plurality of diametrically extending, transversely disposed bores 34, as best shown in FIGS. 3 and 5. In the preferred embodiment the bores 34 are disposed at equally spaced intervals along the length of the cylinder portion 14. Each bore 34 includes a threaded portion 36 having an open end 38 communicating with the inner portion 30 of the elongate slot 28 and an enlarged portion 40 having an open end 42 communicating with the outer surface 26 at a point diametrically opposed in spaced circumferential relation to the slot 28.

An elongate pressure bar 44 which, in the preferred embodiment, is of circular cross section is received into the slot 28. The depth of the slot 28, in the preferred embodiment, is greater than the radius of the pressure bar 44 but somewhat less than the diameter of said bar with the result that the pressure bar 44 projects outwardly of the slot 28 even when seated in the slot inner portion.

A plurality of "dog" point set screws 46, constituting threaded elements, are provided for the cylinder intermediate portion 14, each received in threaded relation within an associated bore 34. Each set screw 46 includes a remote end 48 engageable with the pressure bar 44 tending to move said bar outwardly of its slot 28 when threadedly adjusted as shown in FIG. 5. Each set screw 46 includes a screwdriver-engageable inner end such as a socket 50.

Figure 4:
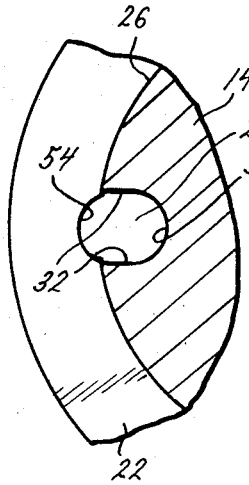
FIG. 4 is a fragmentary cross sectional view taken on line 4—4 of FIG. 1 with the pressure bar removed.

Each of the annular members, for example the rotary knives 18, includes an inner generally cylindrical surface 52 received in sliding relation on the outer surface 26 of the cylinder intermediate portion 14. As shown in FIG. 4 said inner surface includes an arcuate slot 54, extending the full width of the member, and providing a keyway receiving the pressure bar 44. The slots 54, in the preferred embodiment, are minor arcs, that is they are of a depth less than the radius of the circular pressure bar 44 and serve not only to lock the members 18, 20 and 22 in place but also provide a means of aligning said members. In the preferred embodiment the pressure bar 24 is almost exactly the same diameter as the width of the cylinder slot 28 and the arc diameter of the slot 54, a tolerance of $+0/-0.002''$ being preferred to provide superior bearing between the bar 44 and the slot 54. In the embodiment shown, in the engaged position the pressure bar tangent is extended above the cylinder tangent an amount about ten to twenty percent (10%–20%) of the diameter of said bar.

Briefly, the installation of the rotary knives 18, rotary dies 20 and bearers 22 is as follows. The inner surface 52 of each of said members is of a diameter to provide a sliding fit onto the cylinder intermediate portion 14. Preferrably the annular members are slipped over the intermediate portion 14 of the cylindrical member 12 from the left hand, i.e. non-gear, end. Even in its initial position the pressure bar 44 projects outwardly of the slot 28 and therefore provides a simple means of aligning the annular members as they are received on said cylinder intermediate portion.

In the preferred embodiment the bores 34 are spaced so that, except in the case of the bearers 22, each of the annular members is provided with a bore 34 on each side, the bore open ends 42 being clear of said members. Because of this, access to the set screws 46 is unimpeded and, when the set screws are tightened, substantially uniform pressure is applied to the full length of the pressure bar 44. As clearly shown in FIG. 3 inaccessible set screws are not tightened. However, even the provision of only one set screw on each side of a double set of members results in a superior locking arrangement. Preferrably, the radius of the inner portion of the arcuate slot 28 and the radius of the cooperating keyway slot 54 are only slightly larger than the radius of the pressure bar 44. Because of this, when the pressure bar 44 is fully tightened into place a close tolerance fit is obtained and exerted on the full contact surface of the mating arc provided by slot 54. This prevents lateral and longitudinal motion as well as precluding cocking of the annular member and facilitates the locking action and acurate alignment.

In addition to providing superior locking the nature of the connection provides that when the set screws 46 are loosened, the members on the cylinder 14 can be readily shifted longitudinally, and said set screws retightened. In this way the angular positioning of the members is accurately repeatable.

Having described the invention in detail, those skilled in the art will appreciate that modifications may be made without departing from its spirit. Therefore, it is not intended that the scope of the invention be limited to the specific embodiments illustrated and described. Rather, it is intended that the scope of this invention be determined by the appended claims and their equivalents.

We claim as our invention:

1. A rotary die cylinder assembly comprising:

(a) a cylinder including an outer surface, an elongate slot extending lengthwise of said outer surface and a plurality of transverse threaded bores each including opposed ends, one of said ends communicating with the slot and the other of said ends communicating with the outer surface of the cylinder in circumferentially spaced relation to said slot, (b) an elongate pressure bar received within the slot and extendable outwardly of said slot, (c) a plurality of threaded elements each received within an associated bore and each including a remote end engageable with the pressure bar tending to move said bar outwardly of said slot, and (d) a plurality of annular members, each having an inner surface receiving the outer surface of the cylinder in sliding relation, said inner surface including a bearing portion receiving a portion of the bar in pressure relation when the bar moves outwardly.

2. A cylinder assembly as defined in claim 1, in which:

(e) the annular member bearing portion is provided by a slot receiving the pressure bar therewithin.

3. A cylinder assembly as defined in claim 1, in which:

(e) the pressure bar is circular in cross section, and (f) the annular member bearing portion is provided by an arcuate slot receiving the pressure bar therewithin.

4. A cylinder assembly as defined in claim 1, in which:

(e) the transverse bores are diametrically disposed relative to the cylinder.

5. A rotary die cylinder as defined in claim 1, in which:

(e) the annular members are disposed in spaced relation lengthwise of the cylinder, and (f) a transverse bore is disposed at least on each side of at least one of said annular members, the bore end communicating with the outer surface being substantially clear of said annular member.

6. A cylinder assembly as defined in claim 1, in which:

(e) at least one of the annular members is a rotary die.

7. A cylinder assembly as defined in claim 1, in which:

(e) at least one of the annular members is a cylinder bearer.

8. A cylinder assembly as defined in claim 1, in which:

(e) the pressure bar is circular in cross section, (f) the annular member bearing portion is provided by an arcuate slot receiving the pressure bar therein, said slot having a depth less than the radius of the bar.

9. A cylinder assembly as defined in claim 1, in which:

(e) the pressure bar is circular in cross section, (f) the annular member bearing portion is provided by an arcuate slot receiving the pressure bar therein, said slot having a depth less than the radius of the bar, and (g) the cylinder outer surface slot has a lower arcuate portion and an upper portion having parallel sides, said slot having a depth greater than the radius of the bar but less than the diameter of said pressure bar.

10. A rotary die cylinder assembly comprising:

(a) a cylinder including an outer surface, an elongate slot extending lengthwise of said outer surface, and a plurality of diametrically extending bores disposed in spaced relation lengthwise of said cylinder each bore including opposed ends, one end communicating with the slot and the other end communicating with the outer surface of the cylinder each bore including a threaded portion adjacent said one end and an enlarged unthreaded portion adjacent said other end, (b) an elongate pressure bar having a circular cross section and received within the slot, (c) a plurality of set screws each received in threadedly adjustable relation within said threaded portion of the bore and each including a remote end engageable with the pressure bar tending to move said bar outwardly of the slot, and (d) a plurality of annular members each having an inner surface receiving the outer surface of the cylinder said inner surface including an arcuate bearing slot having a depth less than the radius of the pressure bar and receiving said bar in bearing relation when the bar moves outwardly.

11. A cylinder assembly as defined in claim 10, in which:

(e) the set screws are shorter than the length of their associated bores, and (f) said annular members are disposed between adjacent bores and substantially clear of said bores to permit a set screw adjusting tool to be received therein.

12. A rotary die cylinder as defined in claim 11, in which:

(g) the cylinder outer surface slot has a depth greater than the radius of the circular bar but less than the diameter of said pressure bar.

* * * * *